US005282288A

United States Patent [19]

Henson

[11] Patent Number: 5,282,288

[45] Date of Patent: Feb. 1, 1994

[54] ATHLETIC SHOE WITH INTERCHANGEABLE ELEMENTS

[75] Inventor: Tony R. Henson, Piatt County, Ill.

[73] Assignee: NuBreed Corporation, Monticello, Ill.

[21] Appl. No.: 952,278

[22] Filed: Sep. 28, 1992

[51] Int. Cl.[5] ..... A43B 10/00; A43B 13/00; A43B 23/00

[52] U.S. Cl. ..... 12/142 P; 36/28; 36/31; 36/59 A; 36/136; 36/100

[58] Field of Search ..... 36/25 R, 28, 30 R, 31, 36/59 A, 59 B, 59 R, 100, 101, 136, 114; 12/142 P

[56] References Cited

U.S. PATENT DOCUMENTS

| | | | |
|---|---|---|---|
| 4,041,620 | 8/1977 | Anderson | 36/32 R |
| 4,430,810 | 2/1984 | Bente | 36/32 |
| 4,510,700 | 4/1985 | Brown | 36/28 |
| 4,539,585 | 9/1985 | Spackova et al. | 358/93 |
| 4,598,487 | 7/1986 | Misevich | 36/114 |
| 4,616,431 | 10/1986 | Dassler | 36/28 |
| 4,621,441 | 11/1986 | Wagner et al. | 40/2 |
| 4,680,875 | 7/1987 | Danieli | 36/31 |
| 4,697,362 | 10/1987 | Wasserman | 36/136 |
| 4,712,319 | 12/1987 | Goria | 36/137 |
| 4,814,661 | 3/1989 | Ratzlaff et al. | 310/328 |
| 4,823,285 | 4/1989 | Blancato | 364/521 |
| 4,837,960 | 6/1989 | Skaja | 40/636 |
| 4,887,367 | 12/1989 | Mackness et al. | 36/28 |
| 4,905,383 | 3/1990 | Beckett et al. | 36/28 |

FOREIGN PATENT DOCUMENTS

| | | | |
|---|---|---|---|
| 909667 | 10/1962 | United Kingdom | 36/100 |

*Primary Examiner*—Paul T. Sewell
*Assistant Examiner*—M. D. Patterson
*Attorney, Agent, or Firm*—Pitts & Brittian

[57] ABSTRACT

An athletic shoe (10) having interchangeable components for the customizing to the particular needs of a wearer. The wearer's weight, weight distribution, type and level of activity, and other variables are considered when determining the degree and location of support. The athletic shoe (10) includes a base portion (12) which defines a sole member (14) and an upper (16). A plurality of recesses (24) are defined at selected locations by the sole (14) for the receipt of sole inserts (18). The upper (16) defines a plurality of indicia receiving regions. The sole inserts (18) and the indicators (20) may be permanently attached to the athletic shoe (10) by any selected process such as ultrasonic welding. Additional support members may be placed within the athletic shoe (10) as desired to provide further support for selected portions of the foot, including the ankle and the arch.

2 Claims, 3 Drawing Sheets

ATHLETIC SHOE WITH INTERCHANGEABLE ELEMENTS

TECHNICAL FIELD

This invention relates to the field of athletic shoes. More specifically, this invention relates to an athletic shoe which includes interchangeable parts to selectively change the appearance of the shoe and its support capabilities.

BACKGROUND ART

In the field of shoes it is well known that every person distributes their weight differently than the next. Some people bear heavily on the inner portion of their feet while others lean toward the outer portions. Some distribute weight mainly toward their toes while others carry a large portion of their weight with their heels. It is also well known that different sports require the placement of more pressure on some parts of the foot than others.

Due to these factors, it is well known that many different styles of shoes have been developed, each being used typically for a single sport. These dedicated shoes may not be efficiently used for different types of sports. The athlete is not only limited in the construction of the shoe for the particular sport, but is also limited to the number of styles available in that construction.

It is desirable for an athlete to select a style of shoe he/she prefers and then customize the shoe to his/her particular physical characteristics, the particular sport in which he/she will be engaged, and the level of play in which the athlete will engage. It is further desirable in customizing the particular shoe for the particular foot and sport, that a method be provided for determining a proper construction of the shoe which would meet the individual athlete's needs.

Other shoes have been developed for customization or for particular activities. Included are the devices described in the following U.S. Patents:

| U.S. Pat. No. | Inventor | Issue Date |
|---|---|---|
| 4,430,810 | A. Bente | Feb. 14, 1984 |
| 4,598,487 | K. W. Misevich | July 8, 1986 |
| 4,621,441 | K. R. Wagner, et al. | Nov. 11, 1986 |
| 4,697,362 | A. Wasserman | Oct. 6, 1987 |
| 4,712,319 | L. Goria | Dec. 15, 1987 |
| 4,814,661 | M. H. Ratzlaff, et al. | Mar. 21, 1989 |
| 4,837,960 | J. J. Skaja | Jun. 13, 1989 |

Of these devices, the U.S. Pat. No. '810 patent issued to Bente and the U.S. Pat. No. '487 patent issued to Misevich disclose shoes that provide lateral support of the sole proximate the heal of the shoe. These shoes do not provide for the customization of the shoe for the particular wearer depending upon the wearer's weight distribution and sport.

The U.S. Pat. No. '661 patent issued to Ratzlaff discloses a shoe which may be used to measure and analyze the forces exerted by a wearer during normal activities. Ratzlaff does not provide for the alteration of the shoe to suit the individual needs of the wearer.

The U.S. Pat. No. '441 (Wagner), U.S. Pat. No. '362 (Wasserman), U.S. Pat. No. '319 (Goria), and U.S. Pat. No. '960 (Skaja) patents each disclose devices for personalizing the exterior of a shoe by the temporary placement of selected indicia. For example, the former two patents disclose the use of hook-and-loop type fasteners for temporarily maintaining the position of selected indicators while the latter two patents disclose the use of snap-on type indicators. None of the patents discloses a means for permanently affixing selected indicia at selected locations on the shoe.

Other devices have been developed to assist in the point-of-purchase preview of selected articles and services, such as those disclosed in:

| U.S. Pat. No. | Inventor | Issue Date |
|---|---|---|
| 4,539,585 | D. S. Spackova, et al. | Sep. 3, 1985 |
| 4,823,285 | V. L. Blancato | Apr. 18, 1989 |

The devices described in these patents are used as previewing aids for allowing a purchaser of goods or services to view the aesthetics of those goods or services. The U.S. Pat. No. '585 patent issued to Spackova discloses a device for previewing clothing and other selected accessories while the U.S. Pat. No. '285 patent issued to Blancato discloses a device for previewing hairstyles. These devices are used for determining the aesthetic qualities of the goods, and may not be used to measure the weight of the individual or the weight distribution applied to the feet.

Therefore, it is an object of this invention to provide a means for selectively customizing a shoe, especially the sole thereof, for the particular requirements of a wearer dependent upon, among other factors, the weight of the wearer, the weight distribution of the wearer, the particular activity to be performed, and the level of intensity of the activity.

Another object of the present invention is to provide a means for selectively customizing the aesthetic appearance of the shoe upper.

Still another object of the present invention is to provide a means whereby the aesthetic customization of the shoe upper may be made permanent.

Yet another object of the present invention is to provide a means whereby the customization of the sole of the shoe and the customization of the upper of the shoe may be made permanent in similar fashion.

DISCLOSURE OF THE INVENTION

Other objects and advantages will be accomplished by the present invention which provides the capability of customizing a shoe. The athletic shoe having interchangeable components is designed to be customized to particular needs of the wearer. The wearer's weight, weight distribution, type and level of activity, and other variables are considered when determining the degree and location of support. The components may be permanently affixed to the athletic shoe be any selected method including ultrasonic welding. The components may alternatively be temporarily affixed to facilitate the selected interchanging thereof by the wearer.

The athletic shoe includes a body portion which defines a sole member and an upper. A plurality of recesses are defined at selected locations by the sole for the receipt of sole inserts. Each sole insert provides a selected degree of support. The upper defines a plurality of indicia receiving regions. The indicia may be any selected by the wearer. The sole inserts and the indicators may be permanently attached to the athletic shoe by any selected process such as ultrasonic welding.

Other support members may be placed within the athletic shoe as desired. Such support members may serve to provide further support for selected portions of the foot, including the ankle and the arch. The support members placed within the shoe may be placed temporarily using a selected means such as a hook-and-loop type fastener.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

An athletic shoe with interchangeable V elements incorporating various features of the present invention is illustrated generally at 10 in the figures. The athletic shoe 10 is designed for customization to meet the needs of the wearer. The athletic shoe 10 may be selectively customized according to the weight distribution of the wearer, the shape of the wearer's foot, the activity within which the wearer will be engaged, and the level of that activity. Moreover, in the preferred embodiment the appearance of the athletic shoe 10 may be customized to suit the personal tastes of the wearer.

The athletic shoe 10 includes a base 12 to which selected appurtenances may be secured. The base 12 includes a sole 14 of a selected size, and an upper 16. In the preferred embodiment, the sole 14 is fabricated from a selected elastomeric material such as rubber, and the upper 16 is fabricated from a durable material such as leather. However, other materials of manufacture may be incorporated as desired. It is not intended to limit the materials of manufacture of the sole 14 to rubber, nor the upper 16 to leather.

Figure 1:
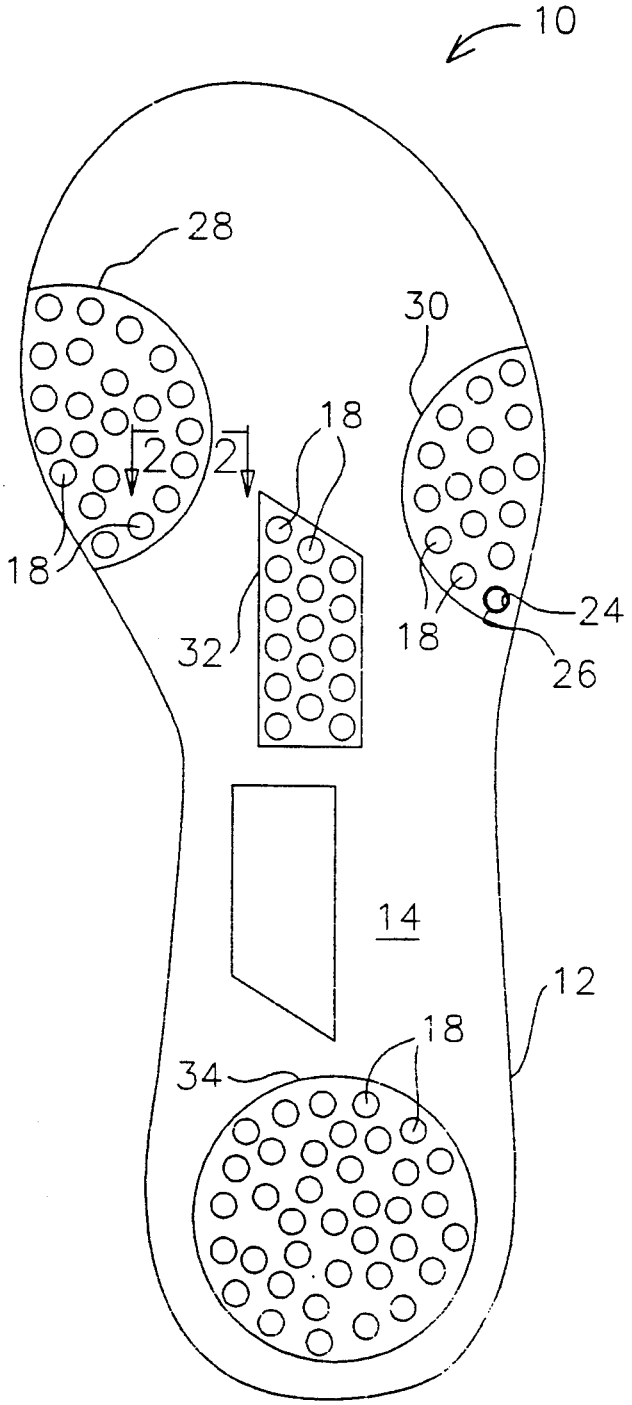
FIG. 1 is a bottom plan view of the athletic shoe constructed in accordance with several features of the present invention.

The sole 14, as depicted in FIG. 1, defines a plurality of recesses 24 opening on the bottom surface 22 thereof. The recesses 24 are typically defined in regions wherein greater pressures are exerted by the wearer's foot. These regions may include the a region 28 proximate the ball of the foot, a region 30 proximate the side of the foot, a central region 32, and a region 34 proximate the heel. As shown, the recesses 24 may be defined in a honeycomb pattern, as shown in the central region 32, or in a circular pattern, as shown in the remaining regions 28,30,34. It may be determined that other patterns are preferable over those depicted and described to better meet the needs of the wearer. In the preferred embodiment, the recesses 24 are defined vertically with respect to the bottom surface 22 of the sole 14.

Figure 2:
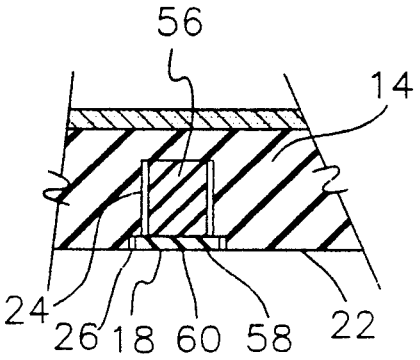
FIG. 2 illustrates an elevation view, in section, of the athletic shoe taken at 2—2 of FIG. 1.
Figure 2A:
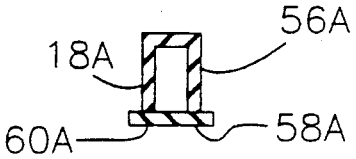
FIG. 2A illustrates an alternate embodiment of a sole insert as depicted in FIG. 2.
Figure 2B:
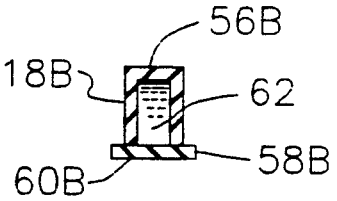
FIG. 2B illustrates an alternate embodiment of a sole insert as depicted in FIG. 2.

As shown in cross-section in FIG. 2, the recesses 24 defined by the sole 14 are defined to receive selected inserts 18. The inserts 18 may define solid members as shown. Alternatively, the inserts may define hollow members, as depicted in FIG. 2A at 18A, or members filled with a selected liquid or other material, as depicted in FIG. 2B at 18B. The inserts 18 are fabricated from a selected material defining a selected degree of resiliency. The selected degree of resiliency may vary between the individual inserts 18 incorporated in a particular athletic shoe 10, dependent upon the previously discussed parameters.

It is envisioned that the selected inserts 18 may provide further benefits than herein described. For example, it is envisioned that an insert 18 may be used to provide greater ability to jump by defining a piston member within, the piston member acting to push the wearer's foot up after being compressed during the peak load-bearing portion of the wearer's stride. This disclosure is not intended to limit the functions of the selected inserts incorporated within the sole of the athletic shoe 10.

Each insert 18 of the preferred embodiment defines a collar portion 58 dimensioned to be received within a further recessed portion 26 of the sole 14. The collar portion 58 may be selectively secured to the further recessed portion 26, thereby securing the insert to the sole 14. In the preferred embodiment, the insert 18 defines an outer face 60 which is substantially flush with the bottom surface 22 of the sole 14.

Figure 3:
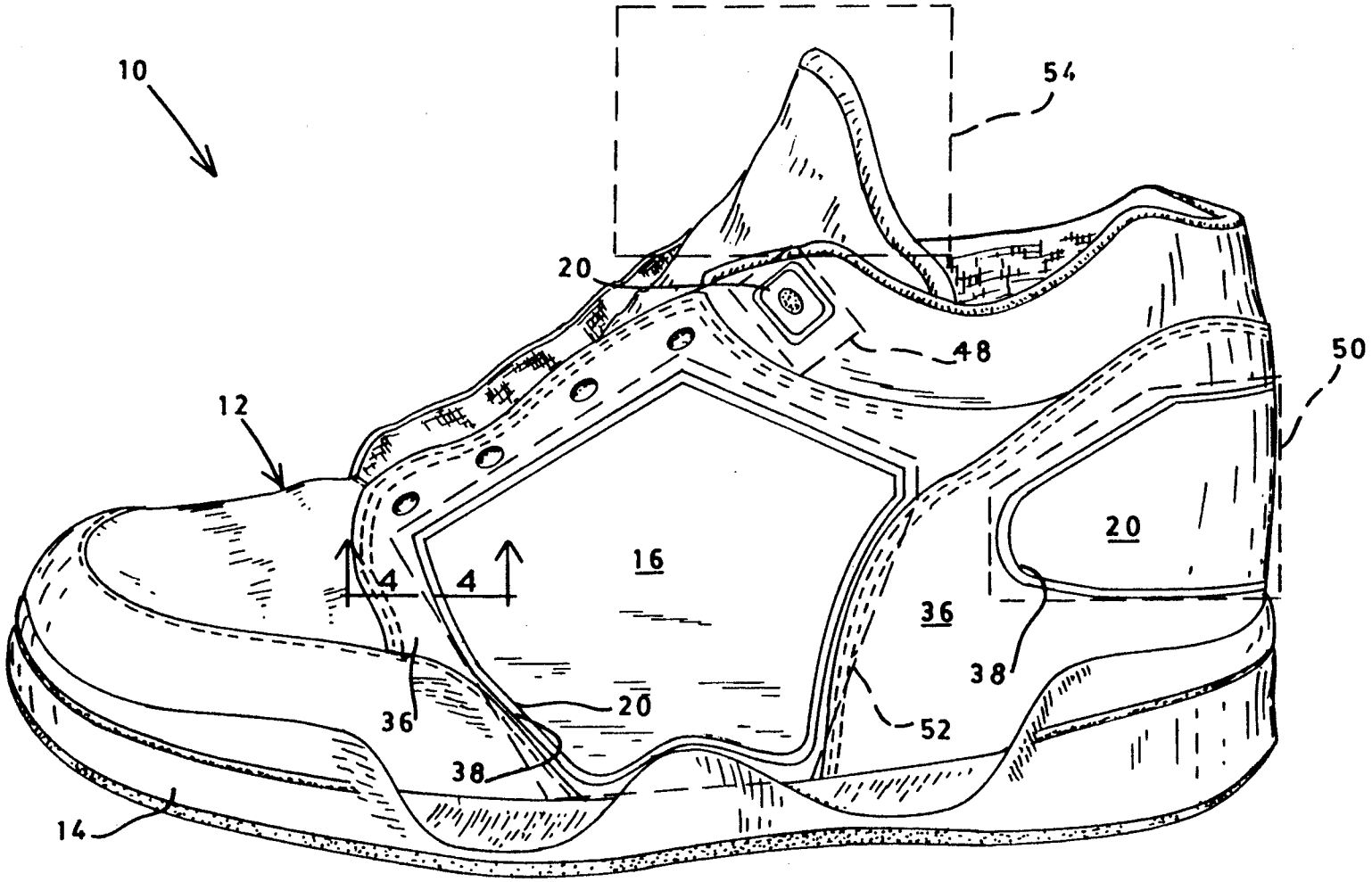
FIG. 3 is a perspective view of a preferred embodiment of the athletic shoe constructed in accordance with several features of the present invention.

As depicted in FIG. 3, the upper 16 defines various indicia regions for the application of selected indicia. The indicia regions depicted include a region 48 proximate the eyelets, a region 50 proximate the heel portion, a region 52 proximate a side, and a region 54 proximate the tongue. Other regions may be selectively used as well.

Figure 4:
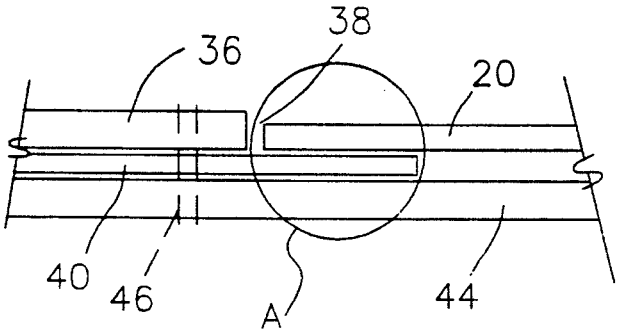
FIG. 4 is a partial cross-sectional view of an upper of the athletic shoe taken at 4—4 of FIG. 3.
Figure 4A:
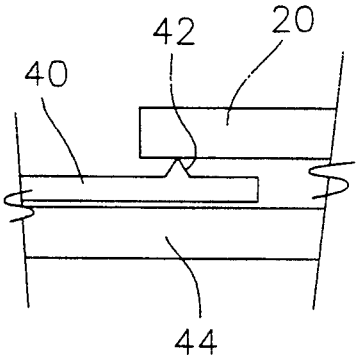
FIG. 4A illustrates an enlarged view of a portion of the partial cross-sectional view shown in FIG. 4.

As shown in FIG. 4, which is a cross-sectional view of an indicia region, the indicia regions 48-54 are defined by an opening 38 in the outer layer 36 of the upper member 16. The opening 38 defines a selected configuration coinciding with the selected region. In the preferred embodiment, a receiving member 40 is positioned beneath the outer layer 36 and is configured to extend at least a selected distance from the edge of the opening 38 toward the central portion of the opening 38. An inner layer 44 is positioned beneath the receiving member 40 and is dimensioned to be at least slightly larger than the opening 38 defined by the outer layer 36 in order to facilitate the securement of the outer and inner layers 36,44. The outer layer 36, the receiving member 40, and the inner layer 44 may be secured one to the other in a typical fashion such as by stitching all around, as depicted at 46.

The indicator 20—the member on which selected indicia is placed—is dimensioned to be received within the opening 38 to engage at its periphery the receiving member 40. The indicator 20 and the receiving member 40 may be selectively attached at the points of engagement. It will be understood that the dimensions and shapes of the indicators and associated openings in the upper are limitless. The indicator 20 may bear any selected indicia such as a school logo, a name, or any other pattern as desired.

The inserts 18 received by the recesses 24 defined by the sole 14 and the indicators 20 received within the openings 40 defined by the upper 16 may be permanently affixed to the respective portions of the athletic shoe 10 in a selected fashion. In the preferred embodiment, the inserts 18 and the indicators 20 may be affixed in their respective locations by the process of ultrasonic welding. As shown in FIG. 2, and as described above, the sole insert 18 defines a collar portion 58 for engaging a further recessed portion 26 defined by the sole 14. In order to facilitate the ultrasonic welding process, the material of manufacture of at least the collar portion 58 of the insert 18 is the same material of manufacture of at least the further recessed portion 26 defined by the sole 14.

The collar portion 58 of the insert 18 and the further recessed portion 26 of the sole 14 may be manufactured from a selected polymer. One polymer which may be incorporated is polyvinylchloride (PVC), or vinyl. During the process of ultrasonic welding, the selected material of manufacture is heated until melted, then allowed to cool. By requiring the manufacture of the cooperating parts to be of the same material, when that material is melted, it will mix. When cooled, the cooperating parts become unitary and permanent. Though not now the preferred method of ultrasonic welding, it is envisioned that the cooperating portions to be welded may be manufactured from different materials, so long as a satisfactory welding of the materials may be accomplished. It is therefore not intended to limit the materials of manufacture to being exactly the same for the cooperating portions of the sole 14 and insert 18.

In like manner, the indicator 20 and the receiving member 40, as discussed above in the description of FIG. 4, define cooperating portions which may be ultrasonically welded together. As shown, the receiving member 40 may define a raised portion 42 to provide a pool of molten material for welding purposes. The raised portion 42 thus serves to enhance the accomplished weld. A raised portion may conceivably be defined by the indicator 20 alternatively to, or in cooperation with, the receiver member 40.

The cooperating portions of the indicator 20 and the receiving member 40 are preferably manufactured from similar materials to inhibit a substantially permanent attachment of the indicator 20 to the upper 16. Again, it is envisioned that these materials may be varied so long as a satisfactory weld may be achieved.

It is envisioned that other methods of permanently affixing the selected inserts 18,20 to the respective portions of the athletic shoe 10 may be incorporated. Therefore it is not intended to limit such a method to ultrasonic welding. Further, it is envisioned that the respective cooperating portions described for the purpose of ultrasonic welding may be defined such as to accomplish a temporary attachment, thereby allowing for the selective interchange of parts to meet varying needs and desires of the wearer.

Though not shown, in order to fully adapt the athletic shoe 10 to the individual needs of the wearer, removable inserts may be placed within the shoe 10. Typical of the removable inserts is an arch support. Some wearers require a high arch, while other require a relatively low arch. Therefore, an arch support member may be selected to provide the required degree of support. The arch support member may be removably secured in a selected manner such as with hook-and-loop type fasteners.

Another typical removable insert may define an inflatable air bag positioned to engage the back of the ankle of the wearer. The air bag may provide cushioning around, and support of, the ankle. The air bag may include a pump and a release valve for the introduction and evacuation of air or other selected fluid. The air bag may be removably secured to the inside of the shoe in a selected manner such as with hook-and-loop type fasteners. The inflatable air bag may also be configured to adapt to other portions of the foot to provide local support, especially where the foot defines abnormalities not otherwise accounted for in the construction of a shoe.

As herein described, the athletic shoe 10 of the present invention may be substantially customized by the individual wearer. The wearer may choose a particular style of athletic shoe 10, and specifically, the style of the upper 16 A number of styles may be provided, including high-top and low-top uppers. The uppers 16 may define various locations and shapes for the placement of cooperating indicators 20. The indicators 20 may be of any selected aesthetic design.

After determining the style of the athletic shoe 10 and the individual indicators 20 to be thereon, the wearer will choose the types of inserts 18 to be placed within the recesses 24 defined by the sole 14. Several different types of inserts 18 may be placed Within the different recesses 24, depending upon the distribution of weight of the wearer and the particular activity within which the wearer will be engaged.

It is envisioned that choosing the types of inserts 18 and the arrangement of the same may be facilitated through the use of a computerized weighing device 66, used in conjunction with a selected series of questions. The computerized weighing device 66 may be used to determine the weight distribution placed upon the feet by measuring pressures along the surface 68 of the device 66. By incorporating the measured weight distribution into a model of typical pressure points created by the selected activities, a weight distribution during the selected activity may be determined, thereby allowing for the estimation of an appropriate arrangement of sole inserts 18.

Figure 5:
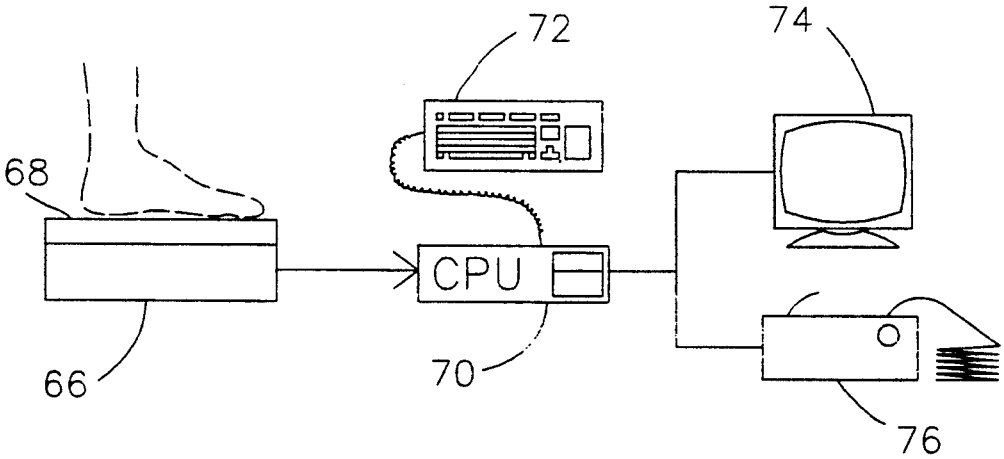
FIG. 5 is a block diagram illustrating several operations of a device constructed in accordance with several features of the present invention.

Referring to FIG. 5, a block diagram illustrates the operations of a preferred embodiment of a computerized weighing device 66. The weighing device 66 of the preferred embodiment includes a weighing surface 68 upon which the wearer will step. The weighing device 66 delivers data to a central processing unit (CPU) 70 to be stored and/or displayed. The CPU 70 may invoke further data input by prompting the wearer, or other user of the CPU 70, to answer selected questions. These questions, as mentioned previously, may inquire as to the selected sport and level of play, and any other questions which may be pertinent to the proper selection of the sole inserts 18. Additional input is received from a typical keyboard 72. After the CPU 70 has received sufficient data to select the proper types and placement of the sole inserts 18, output is delivered to a selected media, including the monitor 74 and/or the printer 76.

As discussed previously, the inserts 18 may be selected to provide greater support at particular locations, while others may provide greater cushioning, or shock absorbing, at others. Further, the inserts 18 may be chosen to more or less resilient depending on the weight of the wearer.

In the preferred embodiment, after the selected indicators 20 and sole inserts 18 have been chosen, each is permanently attached in the selected position. As described, the method for permanently attaching the selected components may include ultrasonic welding. As indicated, some embodiments may provide for a temporary attachment of the selected components.

After the athletic shoe 10 is constructed, the removable components of the inside portion of the athletic shoe 10 may be selected as described. Other foot characteristics may be measured as required to determine whether additional support at selected locations may be necessary. Accordingly, components may be selected and inserted to provide such additional support.

From the foregoing description, it will be recognized by those skilled in the art that an athletic shoe having interchangeable components offering advantages over the prior art has been provided. Specifically, the athletic shoe is designed to be customized to particular needs of the wearer. The wearer's weight, weight distribution, type and level of activity, and other variables are considered when determining the degree and location of support. The components may be permanently affixed to the athletic shoe be any selected method including ultrasonic welding. The components may alternatively be temporarily affixed to facilitate the selected interchanging thereof by the wearer.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A method for customizing an athletic shoe for a selected wearer, said athletic shoe comprising a sole member, an upper member, a plurality of sole inserts dimensioned to be received within said sole member, and a plurality of indicators dimensioned to be received within said upper member, said method comprising the steps of:

(a) weighing said wearer;

(b) determining a weight distribution placed on the feed of said wearer;

(c) selecting said plurality of said sole inserts dependant upon said weight distribution;

(d) selecting said plurality of indicators;

(e) securing said sole inserts to said sole member by ultrasonic welding; and (f) securing said indicators to said upper member by ultrasonic welding.

2. The method of claim 1, after said step of determining a weight distribution placed on the feet of said wearer and before said step of selecting said plurality of sole inserts based upon said weight distribution, further comprising the steps of:

(a) giving answers to a plurality of selected questions relevant to selected activities of said wearer in which said athletic shoe will be worn; and (b) combining said weight distribution and said answers to determine an estimated weight distribution during said selected activities.

* * * * *